US007784659B2

(12) United States Patent
Bilotti

(10) Patent No.: US 7,784,659 B2
(45) Date of Patent: Aug. 31, 2010

(54) ACCESSORY FACILITATING MANUAL DISPENSING OF TOILET PAPER

(76) Inventor: John D. Bilotti, 8546 36th Ave., Kenosha, WI (US) 53142

( * ) Notice: Subject to any disclaimer, the term of this patent is extended or adjusted under 35 U.S.C. 154(b) by 215 days.

(21) Appl. No.: 11/878,968

(22) Filed: Jul. 30, 2007

(65) Prior Publication Data

US 2009/0065546 A1 Mar. 12, 2009

(51) Int. Cl.
*A47K 10/32* (2006.01)
*B26F 3/02* (2006.01)

(52) U.S. Cl. ..... 225/88; 225/6; 225/81; 206/409

(58) Field of Classification Search ..... 225/6, 225/88, 47, 53, 77, 90, 39, 46, 38, 54, 80, 225/81; 242/597.4; 206/409, 395; D6/523, D6/522, 518, 520
See application file for complete search history.

(56) References Cited

U.S. PATENT DOCUMENTS

| | | | | | |
|---|---|---|---|---|---|
| 1,029,490 | A | * | 6/1912 | Connors et al. | 225/43 |
| 1,159,837 | A | * | 11/1915 | Handy | 225/75 |
| 2,110,827 | A | * | 3/1938 | Daykin | 225/46 |
| 2,334,997 | A | * | 11/1943 | Doll | 225/49 |
| 2,379,275 | A | | 1/1944 | Budlong | |
| 2,494,376 | A | | 1/1946 | Coon | |
| D148,484 | S | | 9/1946 | Roche | |
| 2,597,602 | A | * | 5/1952 | Sipior | 225/19 |
| 2,647,028 | A | * | 7/1953 | Larson | 225/6 |
| 2,683,641 | A | * | 7/1954 | Larson | 225/46 |
| 2,839,346 | A | | 10/1955 | Lawalin | |
| 2,872,264 | A | | 4/1956 | Nehring | |
| 3,082,922 | A | * | 3/1963 | Warp | 225/19 |
| 3,104,043 | A | * | 9/1963 | Wyant | 225/51 |
| 3,190,520 | A | * | 6/1965 | Wyant | 225/39 |
| 3,484,052 | A | | 12/1969 | Clarke | |
| 3,580,651 | A | | 5/1971 | Gauper | |
| 3,986,677 | A | | 10/1976 | Ootaki et al. | |
| 4,179,078 | A | | 12/1979 | Mansfield | |
| 4,203,562 | A | | 5/1980 | DeLuca et al. | |
| 4,314,679 | A | | 2/1982 | Paul et al. | |
| D265,700 | S | | 8/1982 | Breger et al. | |
| 4,383,657 | A | | 5/1983 | Suh | |
| 4,389,026 | A | | 6/1983 | Willa et al. | |
| 4,410,221 | A | | 10/1983 | Vallis et al. | |
| 4,739,943 | A | | 4/1988 | Geller | |
| 4,775,109 | A | | 10/1988 | Tegg | |
| 4,811,878 | A | * | 3/1989 | Horinchi | 225/46 |

(Continued)

FOREIGN PATENT DOCUMENTS

| | | |
|---|---|---|
| CH | 404124 | 11/1963 |

(Continued)

*Primary Examiner*—Ghassem Alie
(74) *Attorney, Agent, or Firm*—Jansson Shupe & Munger Ltd.

(57) ABSTRACT

The invention is an accessory facilitating manual, sanitary dispensing of toilet paper from a dispenser rotatably holding a toilet paper roll, the accessory including front and back guide-members defining a paper-movement channel therebetween and having access openings allowing manual engagement of paper in the channel, a paper-detaching edge at the lower end of the guide members, and a dispenser-attaching device at the upper end of the guide-members. In another form, the invention is a complete dispenser incorporating similar apparatus.

17 Claims, 6 Drawing Sheets

U.S. PATENT DOCUMENTS

| | | | | | |
|---|---|---|---|---|---|
| 4,844,368 | A | | 7/1989 | Hu | |
| 4,872,601 | A | * | 10/1989 | Sigmund | 225/38 |
| 4,879,150 | A | | 11/1989 | Schitz et al. | |
| 4,881,675 | A | * | 11/1989 | Varley, III | 225/43 |
| D307,845 | S | | 5/1990 | Omdoll et al. | |
| D310,759 | S | | 9/1990 | Breger | |
| D310,922 | S | | 10/1990 | Sigmund | |
| D312,739 | S | | 12/1990 | Sigmund | |
| D315,652 | S | | 3/1991 | Sigmund | |
| 5,054,676 | A | * | 10/1991 | Ban | 225/42 |
| D335,410 | S | | 5/1993 | Abel et al. | |
| D348,579 | S | | 7/1994 | Brandenburg | |
| D351,520 | S | * | 10/1994 | Frazier et al. | D6/523 |
| D351,749 | S | | 10/1994 | Omdoll et al. | |
| D357,150 | S | | 4/1995 | Morand | |
| D358,516 | S | | 5/1995 | Chen | |
| 5,538,170 | A | * | 7/1996 | Van Luit | 225/47 |
| D373,276 | S | | 9/1996 | Omdoll et al. | |
| 5,605,265 | A | * | 2/1997 | Hanna | 225/46 |
| D406,209 | S | | 3/1999 | Lehmkuhl | |
| 5,954,256 | A | | 9/1999 | Niada | |
| D416,726 | S | | 11/1999 | Kurti et al. | |
| D458,489 | S | | 6/2002 | Omdoll et al. | |
| D458,490 | S | | 6/2002 | Omdoll et al. | |
| 6,609,450 | B2 | | 8/2003 | Gramger | |
| 6,679,409 | B2 | | 1/2004 | Petterson | |
| D499,288 | S | | 12/2004 | Taylor et al. | |
| 7,011,271 | B2 | | 3/2006 | Walters | |
| 2004/0089762 | A1 | | 5/2004 | Salaker et al. | |

FOREIGN PATENT DOCUMENTS

| | | |
|---|---|---|
| EP | 0298931 | 1/1989 |
| GB | 1036952 | 7/1966 |
| GB | 2139703 | 2/1988 |
| JP | 60-80419 | 5/1985 |
| NL | 7409712 | 1/1976 |
| SE | 512595 | 4/2000 |

* cited by examiner

ACCESSORY FACILITATING MANUAL DISPENSING OF TOILET PAPER

FIELD OF THE INVENTION

The present invention is related generally to toilet paper dispensing and, more specifically, to apparatus for dispensing of toilet paper from a roll, as in public restroom facilities.

BACKGROUND OF THE INVENTION

Many public restrooms provide toilet paper in large rolls for which special paper-dispensers have been designed. There is a wide variety of different designs and types of such dispensers with a common principle of operation which is based on having the large roll of paper fully concealed inside the dispenser and an end of the paper hanging from an opening in a bottom of the dispenser below the paper roll. The user grabs and pulls the end of the paper to rotate the roll and obtain a desired length of the paper, which the user then tears off at the bottom of the dispenser.

Toilet paper in most rolls also has perforations dividing a very long continuous length of the paper into sheets of a certain size, a group of which can be easily separated at a perforation line by a sharp pull. Very often, because of such perforations or just because of the thinness and nature of the toilet paper, a simple pull can inadvertently tear the paper at a position inside the dispenser such that the new end of the paper is out of reach of the user, perhaps apart from some extreme hand-maneuver into the bottom of the dispenser. In some other cases, even if the paper is torn at the bottom of the dispenser, the released roll bounces with a backward rotation and pulls the end of the paper inside the dispenser, with the same resulting problem.

In the situations like the ones just described, the user is forced to attempt to find the paper end by reaching inside of the dispenser or trying to manipulate the roll by touching it through the opening in the bottom of the dispenser and rotating it in one or the other direction until the paper end is finally in position to be grasped for further dispensing. Such actions are highly unsanitary because repeated touching of the dispenser and portions of the paper roll by multiple users at least some of which have contaminated fingers can readily expose users to contamination and infection—not to mention concern about contamination and the frustration that accompanies difficulty of use.

In addition, reaching inside the dispenser while not adequately seeing the details of its structure (including any paper-breakage edge, which may be serrated or sharp in some manner) may even result in scratching or puncturing the user's skin, thus further exposing the user to the spread of infection. This becomes an even larger issue if the user is a disabled person with limited movement ability which makes reaching the paper end inside the dispenser a particularly difficult task.

There is a need for an improvement in toilet paper dispensing to allow easy access to the toilet paper.

OBJECTS OF THE INVENTION

It is an object of the invention to provide improved, simpler dispensing of toilet paper overcoming some of the problems and shortcomings of the prior art, including those referred to above.

Another object of the invention is to provide improved dispensing of toilet paper which allows for easy access to the end of the paper and easy unrolling of the paper.

Another object of the invention is to provide improved dispensing of toilet paper from a large roll such that the end of the paper remains outside of the dispenser in which the roll is mounted after tearing away of a length of paper.

Still another object of the invention is to provide improved dispensing of toilet paper (from a fairly inaccessible roll) which minimizes contamination of the dispenser and the paper roll.

Yet another object of the invention is to provide improved dispensing of toilet paper with increased sanitation and minimized risk of injury to a user's hand.

Another object of this invention is to provide a mechanism to be added to paper-dispensing apparatus to facilitate overcoming the problems referred to above.

Still another object of the present invention is to provide an improved, simpler large-roll toilet paper dispenser for use in public facilities and otherwise.

How these and other objects are accomplished will become apparent from the following descriptions and the drawings.

SUMMARY OF THE INVENTION

The present invention is an accessory facilitating manual dispensing of toilet paper from a dispenser rotatably holding a toilet paper roll which has an axis. The inventive accessory includes: front and back guide-members defining a paper-movement channel therebetween, at least the front guide-member having at least one access opening allowing manual engagement of paper in the channel; a paper-detaching edge at the lower end of the guide members; and a dispenser-attaching device at the upper end of the guide-members.

It is preferred that the front and back guide-members be substantially vertical in their position of use, and preferably substantially planar. The planar guide members are preferably closely adjacent to each other with only a thin space between them, sufficient to allow easy movement of a length of toilet paper therebetween while keeping such length of toilet paper in a determined position allowing easy grasping thereof at an access opening. It is highly preferred that the guide-members extend along planes which are substantially parallel to the axis of the toilet paper roll.

In highly preferred embodiments of the present invention, the front guide-member has two opposed lateral access openings. Such access openings are preferably substantial notches in vertical sides of the front guide-member. In such highly preferred embodiments, it is further preferred that the back guide-member have opposed lateral access openings which at least partially overlap (and preferably fully overlap) the access openings of the front guide-member, thereby allowing manual pinching/pulling of paper in the channel to facilitate dispensing. The access openings of the back guide-member are also preferably notches in vertical sides of the back guide-member.

In certain preferred embodiments of the accessory, at least the front guide-member preferably has a bottom access opening allowing manual engagement of paper in the channel near the paper-detaching edge. In preferred versions of such embodiments, the back guide-member also has a bottom access opening at least partially overlapping (and preferably fully overlapping) the bottom access opening of the front guide-member, thereby allowing manual pinching/pulling of paper in the channel near the paper-detaching edge to facilitate dispensing.

In most highly preferred embodiments, the dispenser-attaching device is pivotably securable to the dispenser. The dispenser-attaching device is preferably configured and arranged for suspending the accessory in a position below the paper dispenser. The dispensing accessory of the present invention may be adapted for attachment to a variety of currently existing toilet paper dispensers used in public restrooms.

It is highly preferred that the front and back guide-members be flexible. The term "flexible" as used herein means non-rigid, able to flex slightly from planar to somewhat off-planar orientations.

The present invention also includes a toilet paper dispensing device which incorporates the principal structures of the accessory into the dispenser itself. In such cases the vertical dimensions of the apparatus may be somewhat less then the overall vertical dimensions of a dispenser with the accessory.

Principal uses of the invention are expected to be with the types of dispensers used in public facilities—i.e., dispensers designed to accommodate very large rolls of toilet paper. The large roll in a typical dispenser of this type is mounted therein with its axis perpendicular to the restroom wall on which the dispenser is mounted. It should be noted, however, that the current invention can be adapted for use with different types of dispensers for different sizes of paper rolls. Thus, the present disclosure is in no way limiting to any particular dispenser design or paper roll size.

The toilet paper-dispensing device of this invention includes: a dispenser body holding the toilet paper roll; front and back guide-members defining a paper-movement channel therebetween and secured with respect to the dispenser body, at least the front guide-member having opposed lateral access openings allowing manual engagement of paper in the channel; and a paper-detaching edge is at the lower end of the guide members.

In highly preferred versions of such inventive dispensers, the front and back guide-members have upper ends pivotably secured with respect to the dispenser body. The guide-members are preferably suspended below the dispenser body.

DETAILED DESCRIPTION OF PREFERRED EMBODIMENTS

Figure 1:
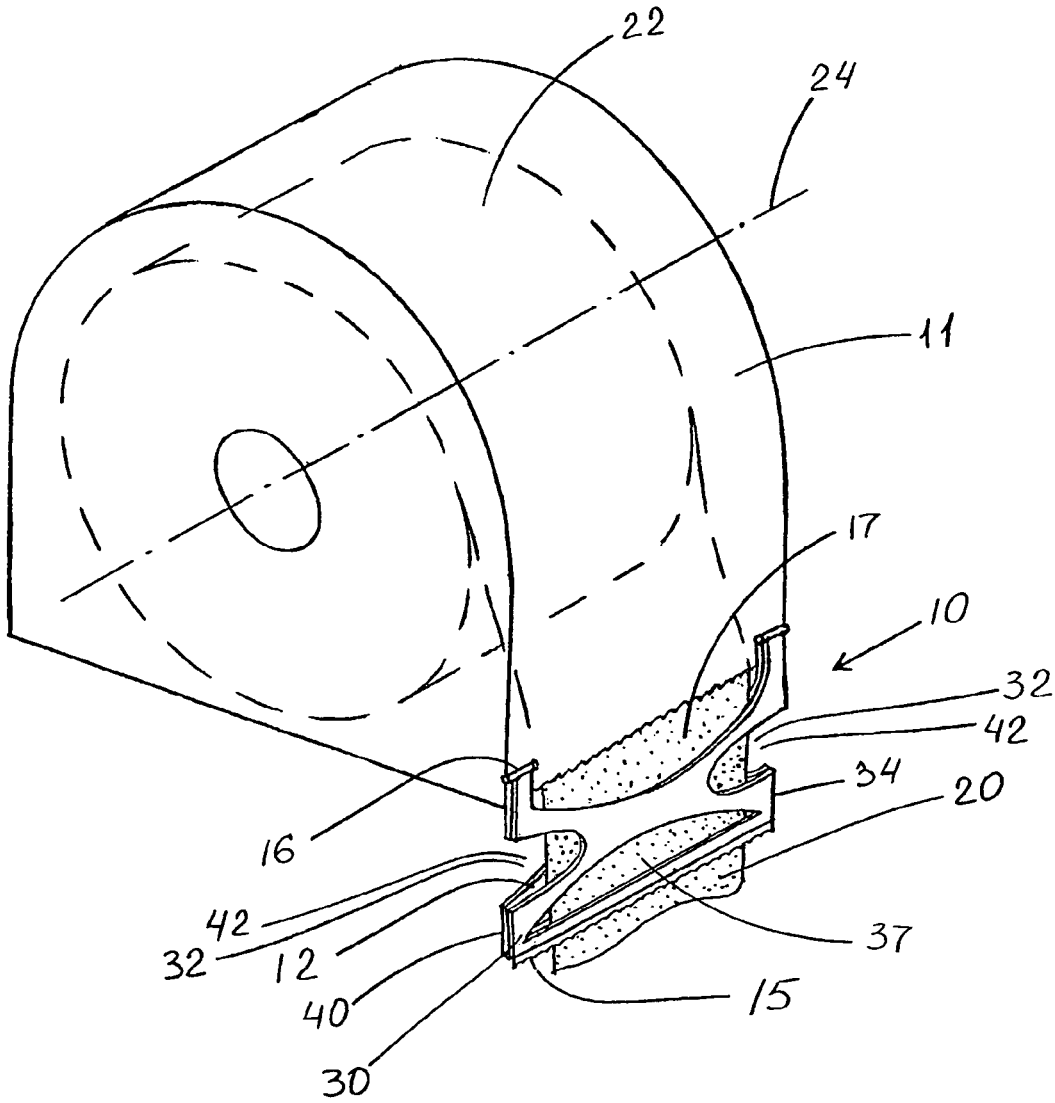
FIG. 1 is a perspective view of a toilet paper dispenser having an accessory in accordance with this invention.
Figure 2:
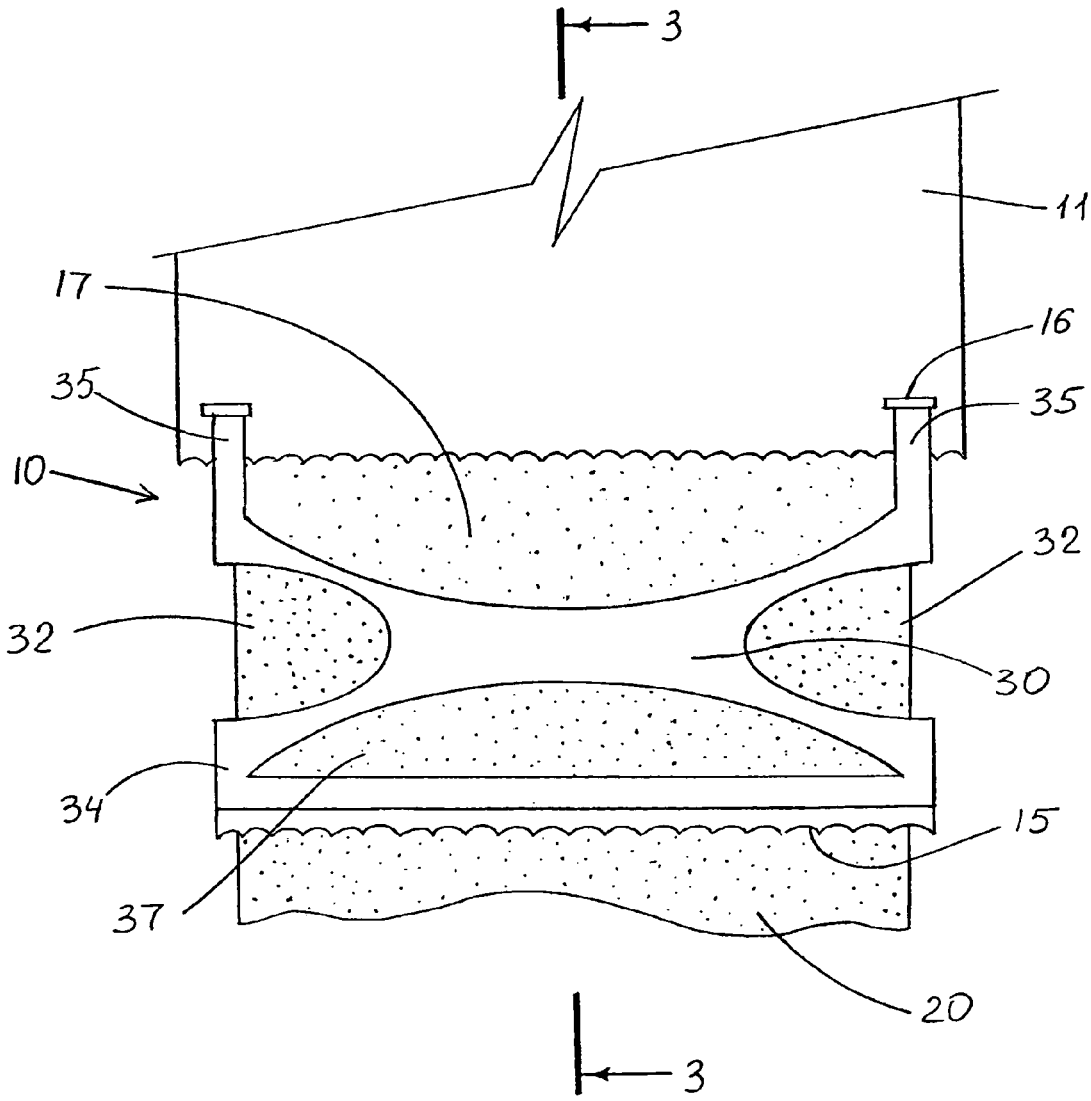
FIG. 2 is an enlarged fragmentary front elevation, showing the accessory of FIG. 1.
Figure 3:
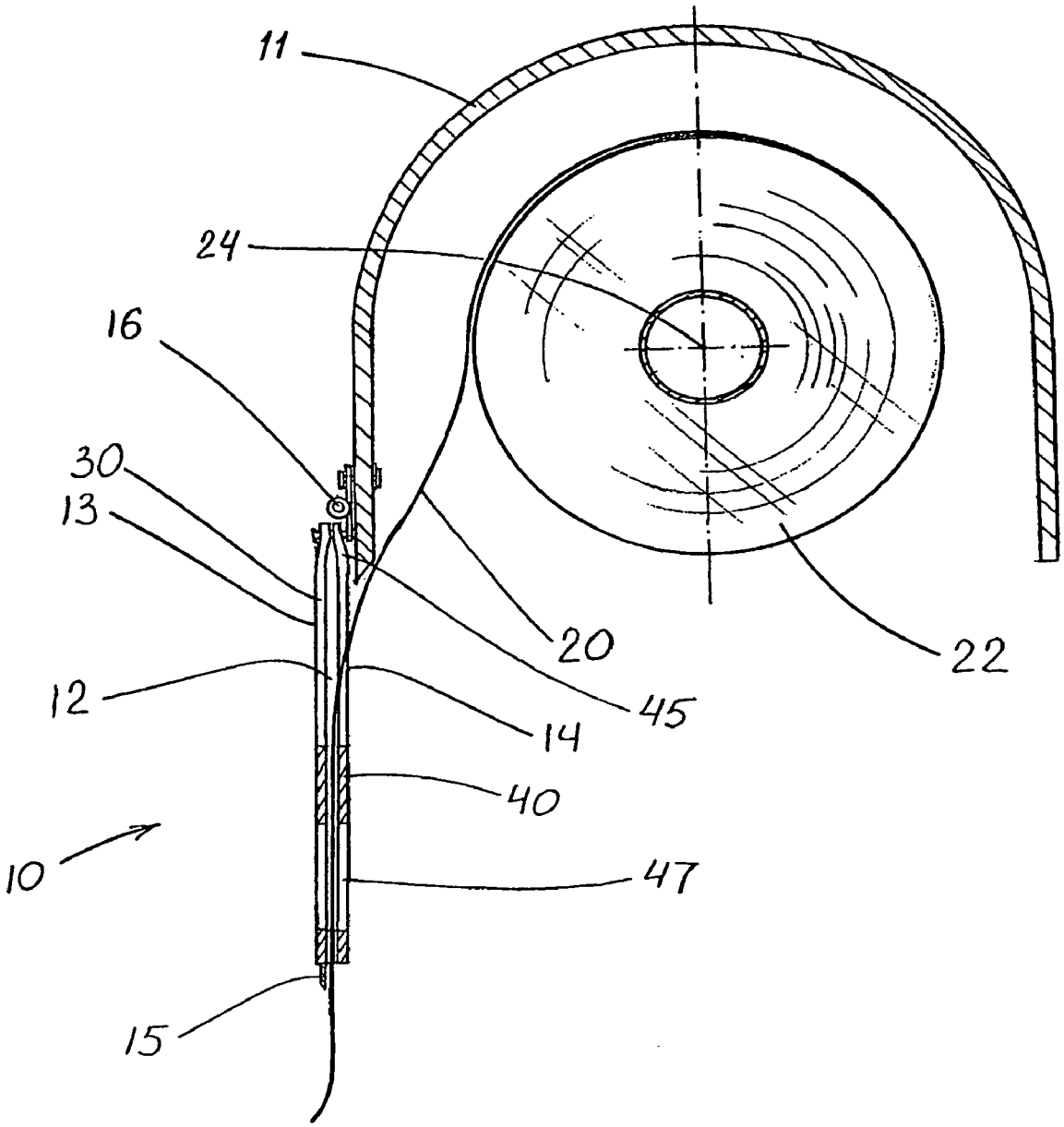
FIG. 3 is a side sectional view taken along section 3-3 as indicated in FIG. 2.

FIGS. 1-4 show an inventive accessory 10 facilitating manual dispensing of toilet paper 20 from a dispenser 11 which rotatably holds a toilet paper roll 22 which has an axis 24. The accessory includes front guide-member 30 and back guide-member 40 defining a paper-movement channel 12 therebetween. As best seen in FIG. 3, guide-members 30 and 40 extend along planes 13 and 14, respectively, which are substantially parallel to axis 24 of toilet paper roll 22. Front guide-member 30 has a pair of lateral access openings 32 and a bottom access opening 37. Likewise, back guide-member 40 has a pair of lateral access openings 42 and a bottom access opening 47 in alignment with lateral access openings 32 and bottom access opening 37, respectively. These access openings allow manual engagement of paper 20 in channel 12 to facilitate withdrawal from dispenser 11.

A paper-detaching edge 15 is at the lower end 34 of front guide member 30. Dispenser-attaching devices 16 are at upper ends 35 and 45 of guide-members 30 and 40, and serve to attach accessory 10 to dispenser 11. Attaching devices 16 are hinges such that accessory 10 is pivotably secured to dispenser 11. Dispensing accessory 10 may be easily adapted for attachment to a variety of currently existing toilet paper dispensers used in public restrooms.

Figure 4:
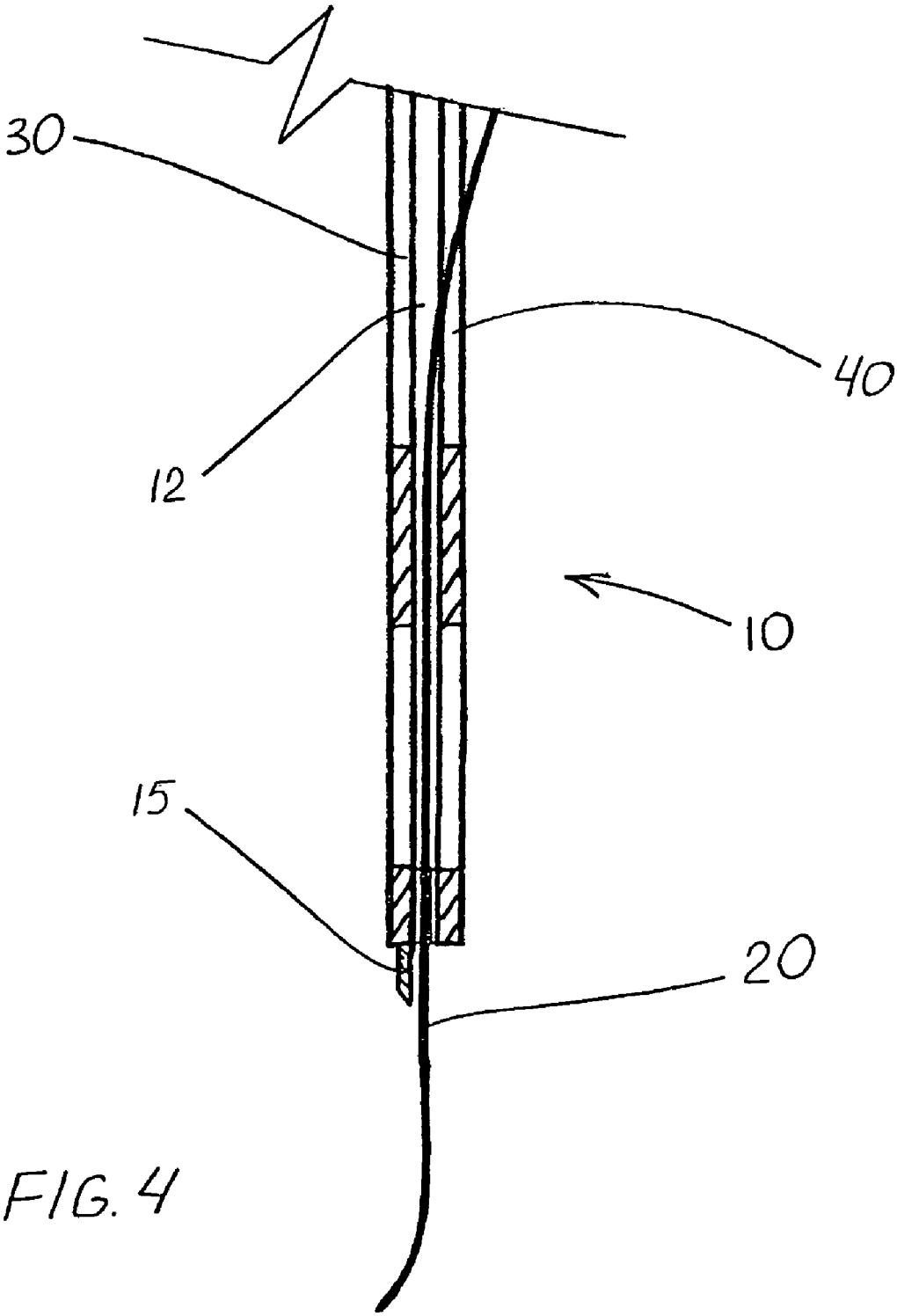
FIG. 4 is an enlarged fragmentary view of FIG. 3, showing detail of the accessory.
Figure 5:
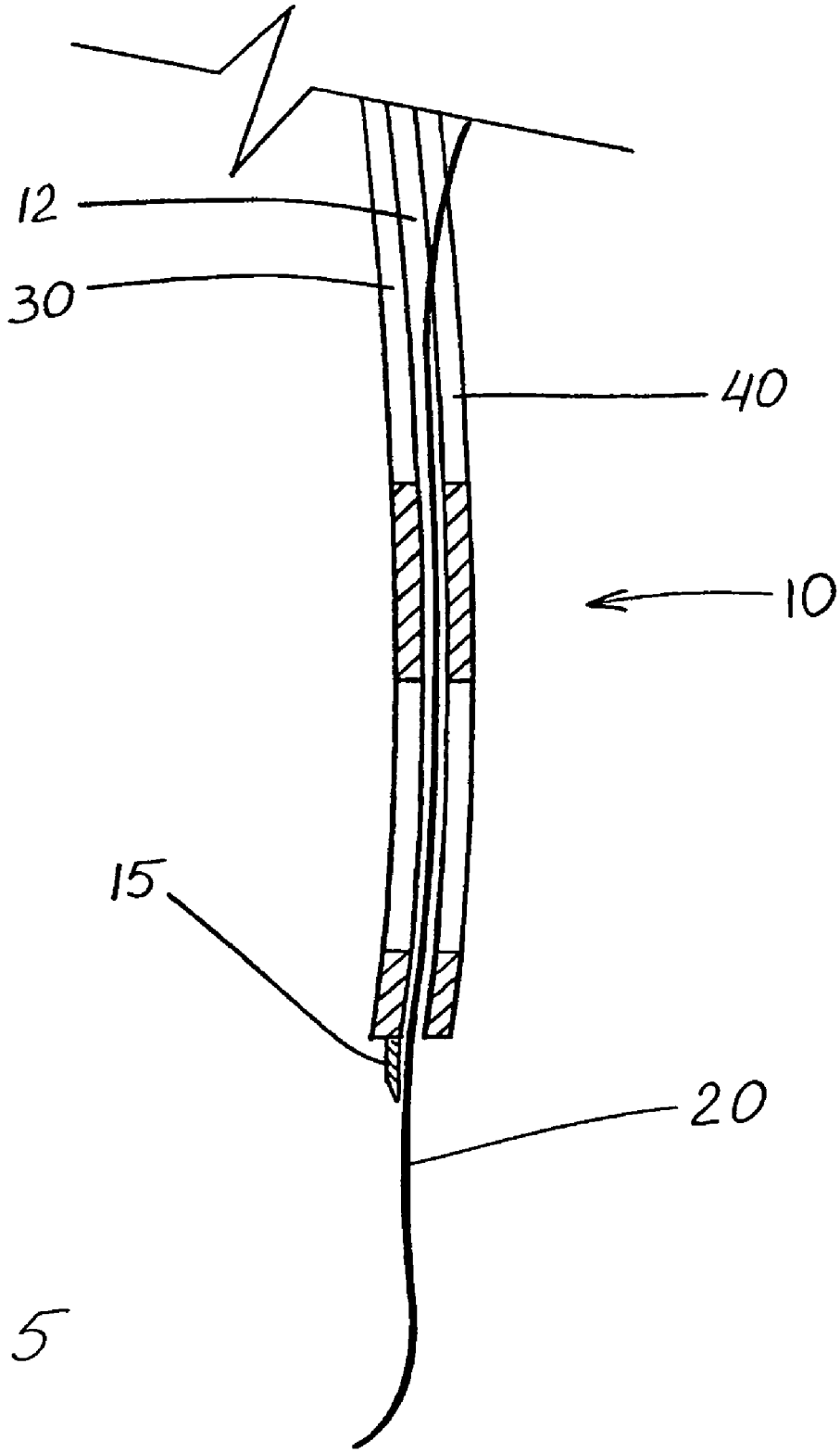
FIG. 5 is an enlarged fragmentary view similar to FIG. 4, but showing the flexibility of the accessory.

FIGS. 3-5 best show that guide members 30 and 40 are closely adjacent to each other, while still allowing unimpeded paper movement through channel 12 therebetween. As can be seen in the FIGS. 1, 2 and 6, accessory 10 also includes an upper access opening 17 which can be used to facilitate insertion of the end of the toilet paper roll from dispenser 11 into channel 12.

FIG. 5 shows that substantially planar front and back guide-members 30 and 40 are flexible, and may be made of any of a wide variety of materials such as flexible plastics which are well-known to those skilled in the art.

Figure 6:
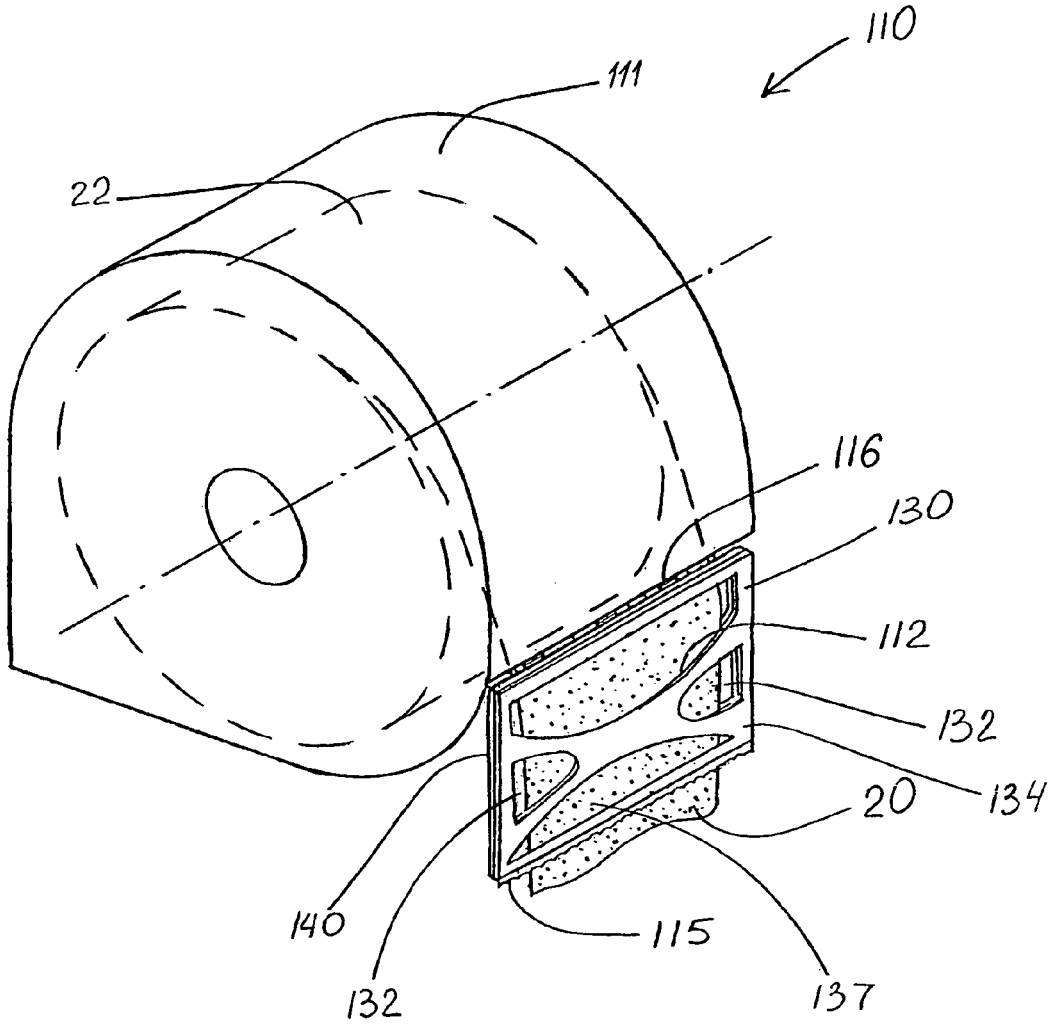
FIG. 6 is a perspective view of a toilet paper dispensing device in accordance with the present invention.

FIG. 6 illustrates a toilet paper dispenser 110 having the characteristics and features of the invention incorporated therein. Dispensing device 110 includes a dispenser body 111 holding toilet paper roll 22. Front and back guide-members 130 and 140 defining a paper-movement channel 112 therebetween and are secured with respect to body 111 by a more substantial hinge 116. Front guide-member 130 has lateral access openings 132 and a lower access opening 137. A paper-detaching edge 115 is at lower end 134 of front guide-member 130.

While the principles of the invention have been shown and described in connection with specific embodiments, it is to be understood that such embodiments are by way of example and are not limiting.

The invention claimed is:

1. A dispenser device for dispensing of toilet paper, comprising: a dispenser body rotatably holding a toilet paper roll having an axis, the toilet paper having opposed lateral edges; and an accessory comprising:

front and back guide-members defining a paper-movement channel therebetween, the front guide-member having a front lateral access notch in a front vertical side edge, and the back guide-member having a back lateral access notch in a back vertical side edge, the front and back side notches being at least partially aligned allowing manual pinching of lateral-edge-adjacent portion of the paper in the channel;

a dispenser-attaching device at the upper end of the guide-members, the dispenser-attaching device being configured and arranged for suspending the accessory in a position substantially below the bottom of the entire dispenser body;

a paper-detaching edge at the lower end of the guide members; and the front guide-member further having a bottom access opening allowing manual engagement of paper in the channel near the paper-detaching edge, and the back guide-member having a bottom access opening at least partially overlapping the bottom access opening of the front guide-member, thereby allowing manual pinching of paper in the channel near the paper-detaching edge to facilitate dispensing.

2. The dispenser device of claim 1 wherein the front and back guide-members are substantially vertical.

3. The dispenser device of claim 1 wherein the front and back guide-members are substantially planar.

4. The dispenser device of claim 3 wherein the front and back guide-members are substantially vertical.

5. The dispenser device of claim 1 wherein the front guide-member has two opposed lateral access notches in the front vertical side edges.

6. The dispenser device of claim 5 wherein the back guide-member has two opposed lateral access openings in the front vertical side edges, the back access openings at least partially overlapping the front assess openings of the front guide-member, thereby allowing manual pinching of lateral-edge-adjacent portion of the paper in the channel to facilitate dispensing.

7. The dispenser device of claim 1 wherein the guide-members extend along planes which are substantially parallel to the axis.

8. The dispenser device of claim 1 wherein the dispenser-attaching device is pivotably securable to the dispenser.

9. The dispenser device of claim 1 wherein the front and back guide-members are flexible.

10. A device for manual dispensing of toilet paper from a roll having an axis, the toilet paper having opposed lateral edges, comprising:

a dispenser body holding the toilet paper roll;

front and back guide-members defining a paper-movement channel therebetween and substantially secured below the bottom of the dispenser body, the front guide-member having opposed lateral access front notches in front vertical side edges, and the back guide-member having opposed lateral back lateral access notches in back vertical side edges, the corresponding front and back side notches being at least partially aligned allowing manual pinching of lateral-edge-adjacent portion of the paper in the channel;

a paper-detaching edge at the lower end of the guide members; and the front guide-member further having a bottom access opening allowing manual engagement of paper in the channel near the paper-detaching edge, and the back guide-member having a bottom access opening at least partially overlapping the bottom access opening of the front guide-member, thereby allowing manual pinching of paper in the channel near the paper-detaching edge to facilitate dispensing.

11. The toilet paper-dispensing device of claim 10 wherein the front and back guide-members are substantially vertical.

12. The toilet paper-dispensing device of claim 10 wherein the front and back guide-members are substantially planar.

13. The toilet paper-dispensing device of claim 12 wherein the front and back guide-members are substantially vertical.

14. The toilet paper-dispensing device of claim 10 wherein the guide-members extend along planes which are substantially parallel to the axis.

15. The toilet paper-dispensing device of claim 10 wherein the front and back guide-members have upper ends pivotably secured with respect to the dispenser body.

16. The toilet paper-dispensing device of claim 15 wherein the guide-members are suspended substantially below the bottom of the entire dispenser body.

17. The toilet paper-dispensing device of claim 10 wherein the front and back guide-members are flexible.

* * * * *